US009732568B2

(12) United States Patent
Lindberg

(10) Patent No.: US 9,732,568 B2
(45) Date of Patent: Aug. 15, 2017

(54) GRIPPER FOR A DRILL STRING COMPONENT HANDLING DEVICE, METHOD FOR MANOEUVRING A GRIPPER, DRILL STRING COMPONENT DEVICE AND ROCK DRILL RIG

(71) Applicant: Atlas Copco Rock Drills AB, Örebro (SE)

(72) Inventor: Johan Lindberg, Saltsjö-boo (SE)

(73) Assignee: Atlas Copco Rock Drills AB, Örebro (SE)

( * ) Notice: Subject to any disclaimer, the term of this patent is extended or adjusted under 35 U.S.C. 154(b) by 253 days.

(21) Appl. No.: 14/651,493

(22) PCT Filed: Dec. 6, 2013

(86) PCT No.: PCT/SE2013/051463

§ 371 (c)(1),
(2) Date: Jun. 11, 2015

(87) PCT Pub. No.: WO2014/098731

PCT Pub. Date: Jun. 26, 2014

(65) Prior Publication Data

US 2015/0330163 A1 Nov. 19, 2015

(30) Foreign Application Priority Data

Dec. 21, 2012 (SE) ..... 1251484-0

(51) Int. Cl.
*E21B 19/087* (2006.01)
*E21B 19/16* (2006.01)
(Continued)

(52) U.S. Cl.
CPC ..... *E21B 19/14* (2013.01); *B25B 13/32* (2013.01); *E21B 7/025* (2013.01); *E21B 19/087* (2013.01)

(58) Field of Classification Search
CPC .... E21B 19/087; E21B 19/161; E21B 19/163; E21B 19/16; B25B 5/147; B25B 5/166; B25B 13/32; B25B 13/505
See application file for complete search history.

(56) References Cited

U.S. PATENT DOCUMENTS 3,202,449 A * 8/1965 Lemelson ..... B25J 15/0213 294/106
5,669,653 A * 9/1997 Penisson ..... E21B 19/163 294/116
(Continued)

FOREIGN PATENT DOCUMENTS

CN 2809197 Y 8/2006
CN 200952363 Y 9/2007
(Continued)

OTHER PUBLICATIONS

PCT/ISA/210—International Search Repfort—Apr. 17, 2014 (Issued in Application No. PCT/SE2013/051463).
(Continued)

*Primary Examiner* — Cathleen Hutchins
(74) *Attorney, Agent, or Firm* — Venable LLP; Jeffri A. Kaminski

(57) ABSTRACT

A gripping device for a drill string component handling device in a rock drill rig. Gripper element pairs are supported by a body and include at least one gripper element, being pivotally movable around a pivot joint, between a closed position, including a gripping position, and an open position. The pivotally movable gripper element is pivotal in a respective gripper plane forming a right angle to an axial direction. Each movable gripper element includes an actuation portion, which co-operates with a wedge device being movable in directions parallel to the axial direction for pivoting said movable gripper element. A method, a drill string component handling device for a rock drill rig and a rock drill rig including a drill string component handling device.

21 Claims, 5 Drawing Sheets

(51) Int. Cl.

| | |
|---|---|
| ***B25B 13/32*** | (2006.01) |
| ***E21B 19/14*** | (2006.01) |
| ***E21B 7/02*** | (2006.01) |

(56) References Cited

U.S. PATENT DOCUMENTS

| | | | |
|---|---|---|---|
| 5,702,139 | A | 12/1997 | Buck |
| 6,116,118 | A | 9/2000 | Wesch, Jr. |
| 6,270,136 | B1 | 8/2001 | Dagenais |
| 2011/0148133 | A1 | 6/2011 | Hessels et al. |

FOREIGN PATENT DOCUMENTS

| | | | |
|---|---|---|---|
| CN | 102828703 | A | 12/2012 |
| GB | 2305878 | A | 4/1997 |
| WO | WO-2007/115375 | A1 | 10/2007 |
| WO | WO-2009/134117 | A1 | 11/2009 |

OTHER PUBLICATIONS

PCT/ISA/237—Written Opinion of the International Searching Authority—Apr. 17, 2014 Issued in Application No. PCT/SE2013/051463).

Chinese Office Action—Apr. 5, 2016 (Issued in Application No. CN 201380066594X).

* cited by examiner

GRIPPER FOR A DRILL STRING COMPONENT HANDLING DEVICE, METHOD FOR MANOEUVRING A GRIPPER, DRILL STRING COMPONENT DEVICE AND ROCK DRILL RIG

CROSS-REFERENCE TO RELATED APPLICATIONS

The application claims priority to Swedish patent application 1251484-0 filed 21 Dec. 2012 is the national phase under 35 U.S.C. §371 of PCT/SE2013/051463 filed 6 Dec. 2013.

FIELD OF THE INVENTION

The invention relates to a gripping device for a drill string component handling device of a rock drill rig, wherein the gripping device includes gripper elements. The invention also relates to a device for handling drill string components and a rock drill rig.

BACKGROUND OF THE INVENTION

Handling of drill string components for transfer of the components between a magazine and a rock drill rig is today generally made manually in many rock drill rigs. This manual handling is, however, risky and stressful for the operator and might therefore lead to serious injuries because of accidents with e.g. falling drill string components. The handling also results in a risk for persons required to lift and position often heavy as well as cumbersome and long drill string components to be subject to strain injuries.

From AU-B-64377/96 is previous known a drill string component handling device, wherein a drill string component is placed in a support being comprised of a holder having a one way hole. The holder is pivotal and movable between desired positions for a held drill component.

A problem with the device according to said AU-document is the lacking precision resulting when the drill string component is to be connected to the drill string because of length and weight of the drill string in combination with holding at only one end of the drill string component: This poses problems with the control and unwanted great variation of the position of a free end of the drill string component.

Lacking precision in at this stage tends to lead to risks for thread damages on the drill string component. The construction is also required to use specially made details which is expected to result in a relatively high cost.

As an example of tube handling devices with grippers having two gripping claws being positioned at a distance from each other can be mentioned WO 2007/115375.

AIM AND MOST IMPORTANT FEATURES OF THE INVENTION

It is an aim of the present invention to provide a gripping device according to the above, which addresses and at least reduces the problems of the background art. This is achieved with a gripping device as mentioned initially in that the gripper elements are supported by and protrude from one side of a body, that the gripper elements form at least one gripper element pair, wherein at least one gripper element in a gripper element pair is pivotally movable around a pivot joint between a closed position, comprising a gripping position, and an open position, that each movable gripper element is pivotal in a respective gripper plane forming a right angle to said axial direction, and that each movable gripper element is provided with an actuation portion, which co-operates with a wedge device being movable in directions parallel to said axial direction for pivoting said movable gripper element.

The chosen solution gives the possibility to construct the gripping device very robust and in such a way that a great force can be applied to a gripped drill string component. The invention also results in essentially enhanced precision, such that joining to a drill string in a drill rig is simplified and made faster. Further, the gripping device can be made compact such that it can be used in places where other types of gripping devices can not be used for space reasons. Further, the gripping device can be constructed strong and secure and such that it can grip and deliver gripped drill string components with great precision.

It is preferred that each movable gripper element is provided with the pivot joint between an engagement portion for a co-operation with a gripped drill component and the actuation portion.

It is also preferred that the actuation portion is pivotally joined to a contact block which lies in contact with the wedge device. The contact block can be provided with an appropriately designed sliding surface for co-operation with the wedge device. This solution gives a required good surface contact with and thereby force transfer from the wedge device for all angular positions of the gripper.

A spring device is suitably arranged inside the body for actuation of said movable gripper elements against the open position. Hereby is ensured that the gripper elements open as intended without having to be for example force moved in an opening direction.

It is preferred that at least two gripper element pairs for gripping a drill string component are arranged at a distance from each other on the body. Hereby is intended that the gripper element pairs are arranged at a distance from each other in a direction parallel to an axial direction of the gripped drill string component in order to ensure increased stability in the gripping position and increased handling precision.

It is preferred that said wedge device is connected to a hydraulic cylinder, wherein suitably each gripper element pair is maneuvered by a separate wedge device, which is connected to a separate associated hydraulic cylinder. It is, however, also possible having both gripper element pairs manoeuvred by a common wedge device which is connected to an associated hydraulic cylinder.

It is suitable that each hydraulic cylinder is provided with a hydraulic lock, which prevents movement of the hydraulic cylinder in case of lost hydraulic pressure in associated hydraulic conduits. Hereby is avoided that the gripping device fails with a dropped drill string component as a result.

The wedge mechanism can, however, be constructed to be self-braking meaning that an active actuation in an opening direction of the wedge mechanism is required and that in case of no actuation, the gripping device will be self-locking. This is an important security aspect which prevents a drill string component to be dropped in case of force drop out or any other failure.

The wedge device is preferably linear controlled between fixed guiding elements arranged inside the body for ensuring predictable gripper movements.

Most preferred both gripper elements in each gripper element pair are pivotally movable gripper elements, and the wedge device hereby exhibits wedge surfaces facing in different directions for co-operation with the movable gripper elements in a gripper element pair.

It is suitable that the body has a protective cover for covering respective actuation portion and associated movable wedge device in order to reduce the risk of dirt etc. entering.

The invention also concerns a method for maneuvering a gripping device for a drill string component handling device in a rock drill rig, wherein each movable gripper element is pivoted in a respective gripper plane forming a right angle to said axial direction, and wherein an actuation portion on each movable gripper element co-operates with a wedge device for pivoting said movable gripper element.

Features that are preferred in respect of the gripping device are also applicable in respect of variants of the method.

The invention also concerns a drill string component handling device for a rock drill rig including an inventive gripping device for gripping drill string components, a displacement mechanism being attachable to the rock drill rig and supporting the gripping device.

The invention also concerns a rock drill rig including such a drill string component handling device.

Further features and advantages of the invention are explained in the detailed description below.

BRIEF DESCRIPTION OF DRAWINGS

The invention will now be described more closely by way of embodiments and with reference to the drawings, wherein.

DESCRIPTION OF EMBODIMENT

Figure 1:
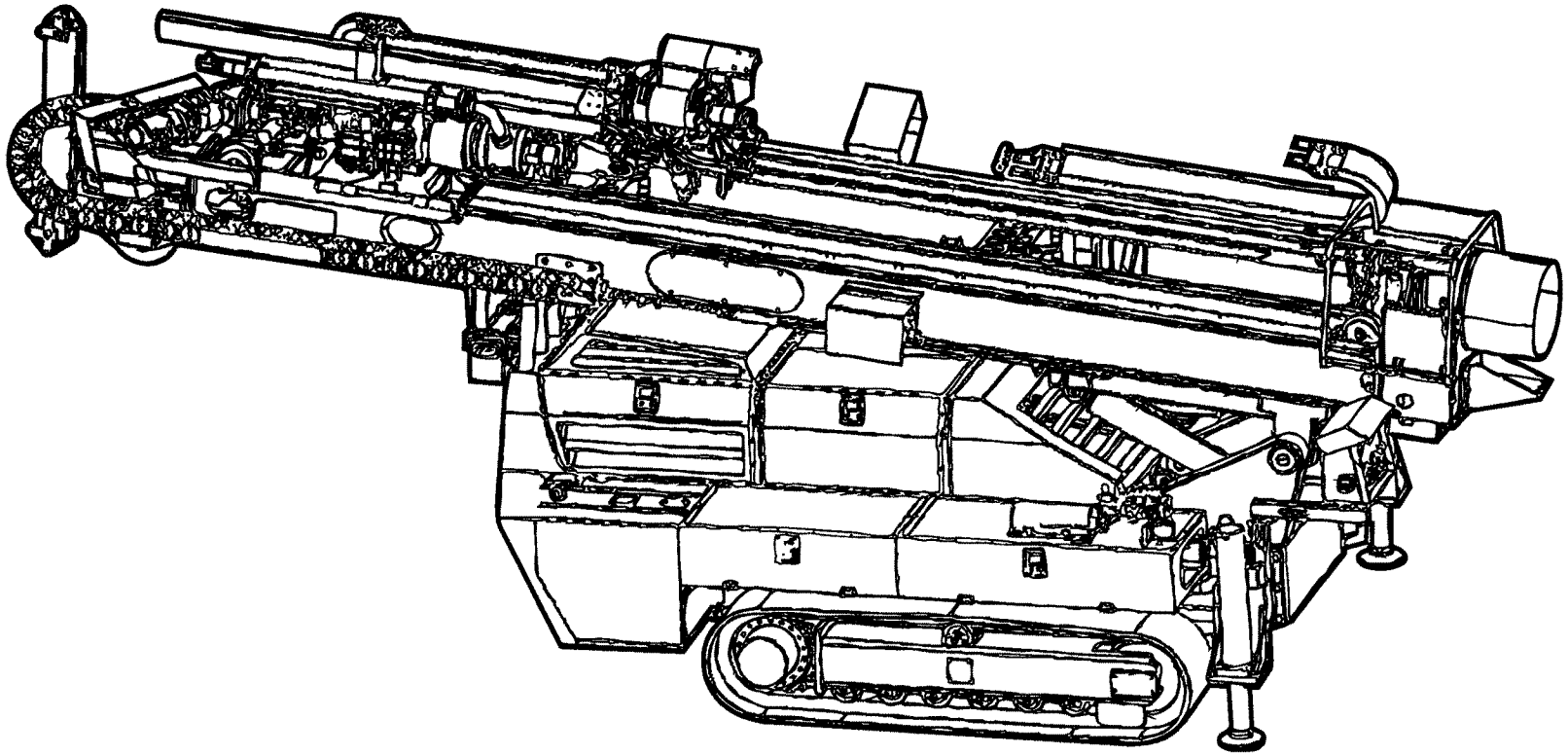
FIG. 1 shows a rock drill rig with a drill string component handling device equipped with a gripping device according to the invention.

In FIG. 1 is shown a rock drill rig for exploration drilling, wherein during the drilling a great number of drill string components are normally handled. The exploration drilling normally takes place at great or very great depths resulting in that the entire drill string has to be taken up to the surface regularly for replacement of the drill bit.

During this process, firstly the separate drill string components of the drill string have to be loosened from the drill string, moved from the drill rig and be positioned in a magazine right up to when the last drill string component has been taken up from the bore hole. Thereupon change of drill bits takes place whereupon the drill string is successively reassembled by the drill string components, the one after the other, is added to the drill string until the previous depth has been reached. Thereupon drilling can proceed a further length, whereupon the method according to the above has to be repeated.

Exploration drilling is basically according to two principles, namely through core drilling and through so called RC-drilling. During core drilling, a core of the rock material to be investigated is drilled and picked up from the bore hole with regular intervals. During RC-drilling or RC-prospecting (RC means Reverse Circulation) drilled cuttings having been loosened through drilling is continuously flushed up from the hole. The rock cuttings are thereupon taken care of at the surface, are continuously stored such that they are accessible for examination and can be related to the drill depth where cut.

RC-drilling prospecting typically takes place at lesser depths than core drilling prospecting.

The present invention is applicable in respect of drill rigs for both these kinds of exploration drilling.

Figure 2:
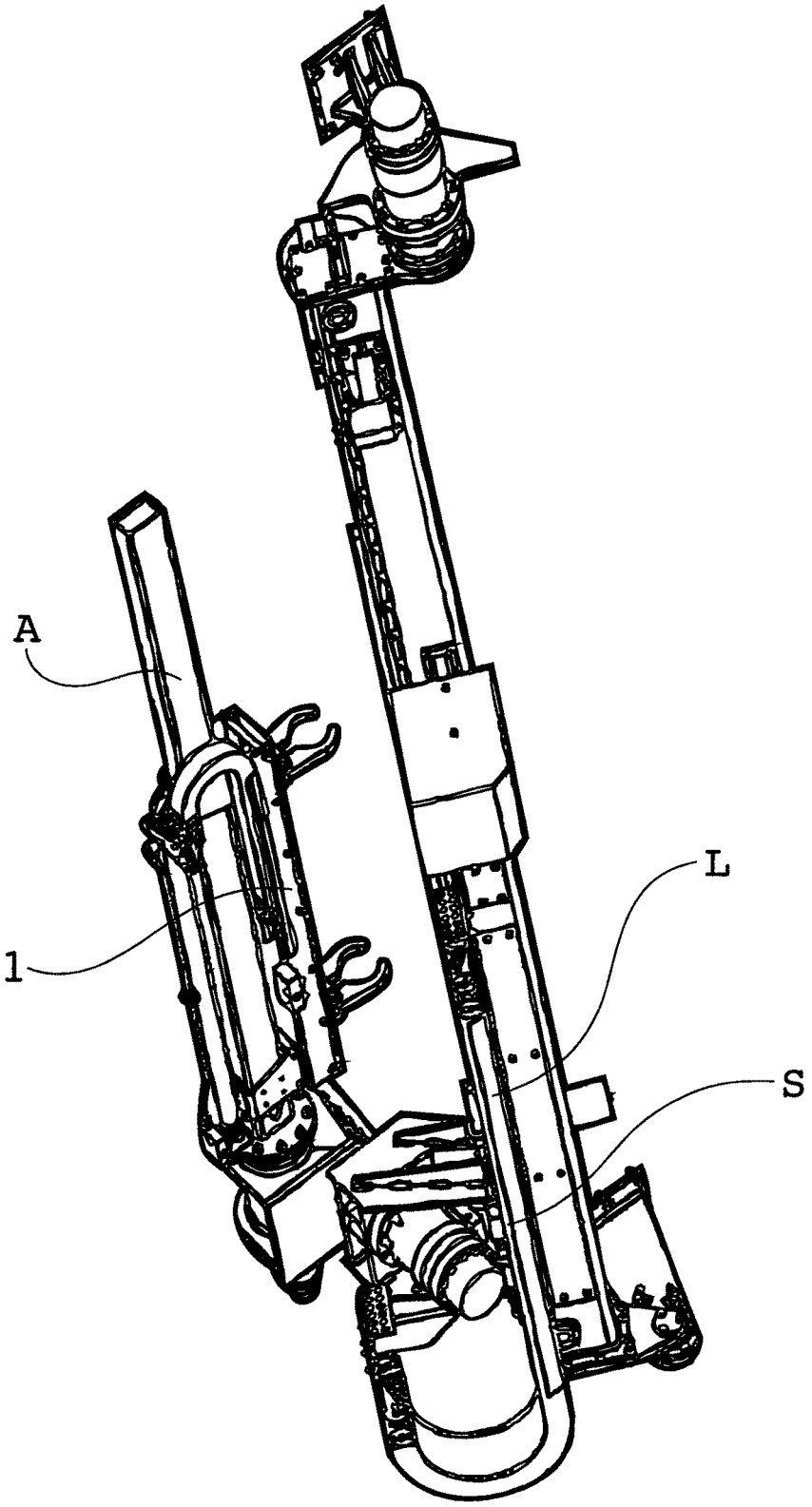
FIG. 2 shows a drill string component handling device equipped with a gripping device according to the invention.

The handling device which is fastenable to the feed beam of the rig as seen in FIG. 2 includes a linear guide L, whereon a slide S is drivingly displaceable. A swing arm A is swingable and rotatable with the aid of rotators which are not described in more detail here, in order to be positioned in order to be able to grip, move and release a drill string component in a drill string position in the rig respectively a delivering position in a magazine or in any other external position.

Figure 3:
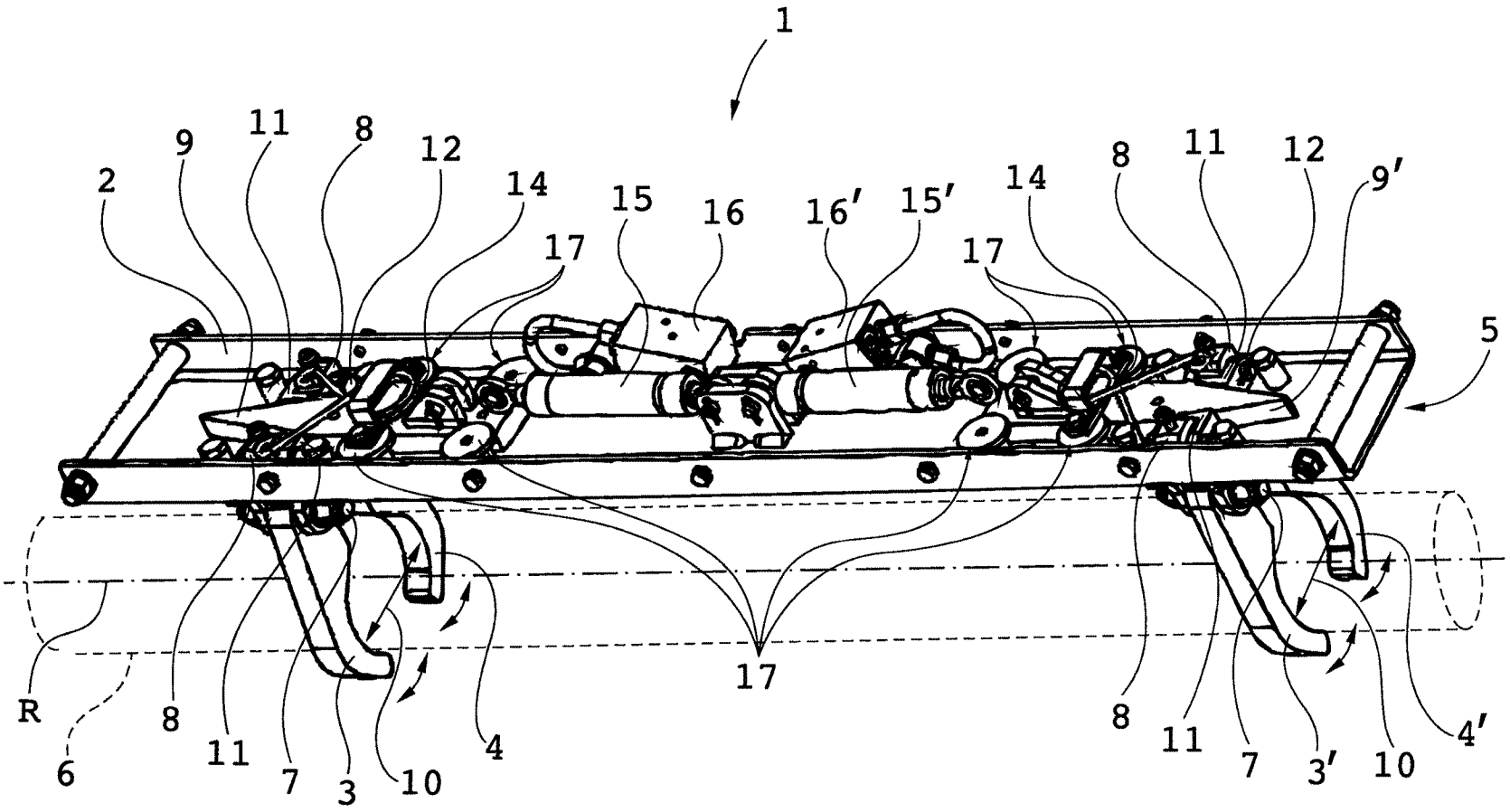
FIG. 3 shows in detail a gripping device according to the invention in a disassembled perspective view.

FIG. 3 shows that the gripping device 1 includes a longitudinal body 2, which supports gripper element pairs in the form of two grip jaw pairs 3, 4 and 3', 4'. Said grip jaw pairs are arranged at a distance from each other as seen in an axial direction R of a gripped drill string component 6 (indicated with interrupted lines). The axial separation of the gripper element pairs/the grip jaw pairs results in stable handling and in that movements of the long, heavy drill string components can be controlled in an advantageous way. The grip jaw pairs 3, 4 and 3', 4' protrude from one side 5 of the longitudinal body 2 and in the shown embodiment, in each grip jaw pair both grip jaws in the pair are pivotally movable (indicated with double arrows) in a gripper plane forming a right angle to said axial direction R.

The grip jaw pairs are manoeuvrable between a closed position being a gripping position for gripping a drill string component 6 and an open position where the grip jaws are pivoted from each other such that a gripped drill string component is made free respectively can be introduced between the grip jaws and be gripped.

Each movable grip jaw 3, 4, 3', 4' is provided with an actuation portion 8, which co-operates with a wedge device 9, 9'. The wedge device 9 is movable in directions parallel to said axial direction R.

The actuation portion 8 of each grip jaw is further pivotally joined to a contact block 11, which in turn is arranged to abut the wedge device 9 and which for that reason is provided with a contact surface in the form of a slide guide, the surface of which extending at an angle corresponding with an angle of a co-operating wedge surface of the wedge device 9.

Each contact block 8 is over a pivot pin 12 (two indicated) connected with an end portion comprising the actuation portion 8 of the respective grip jaw such that a movement of the wedge device 9 initiates a corresponding movement of the contact block 11, of the actuation portion 8 and thereby of an engagement portion 10 comprising a surface of the respective grip jaw engaging a gripped drill string component.

Swinging the grip jaw 3, 4, 3', 4' takes place around a respective pivot joint 7 being comprised of a pivot pin positioned in a pivot pin seat arranged for that purpose on said side 5 of the body.

14 indicates a spring device which is secured in the body and which force influences said movable grip jaws 3, 4 in the direction of the open position. Furthermore, the spring device 14 is comprised of a spring constructed as a pair of shears, the shanks of which engaging with pins or screws or the like being arranged at the extreme ends of the actuation portion 8 of the respective grip jaw.

The wedge devices 9, 9' are each one manoeuvred by a hydraulic cylinder 15, 15' for the to and fro movements. Each hydraulic cylinder 15, 15' is preferably equipped with the hydraulic lock 16, 16' which allows hydraulic oil passage and this way only allows movement of the hydraulic cylinder 15 during the existence of a hydraulic pressure in adjoining hydraulic conduits and interrupts hydraulic oil passage and thereby prevents movement in case hydraulic pressure is lost.

The wedge device 9 is linear guided in the body 2 by guiding elements 17 in the form of hat-shaped elements positioned at each side of the wedge device. The guiding elements provide a guide laterally as well as in a height direction of the wedge device.

Figure 4A:
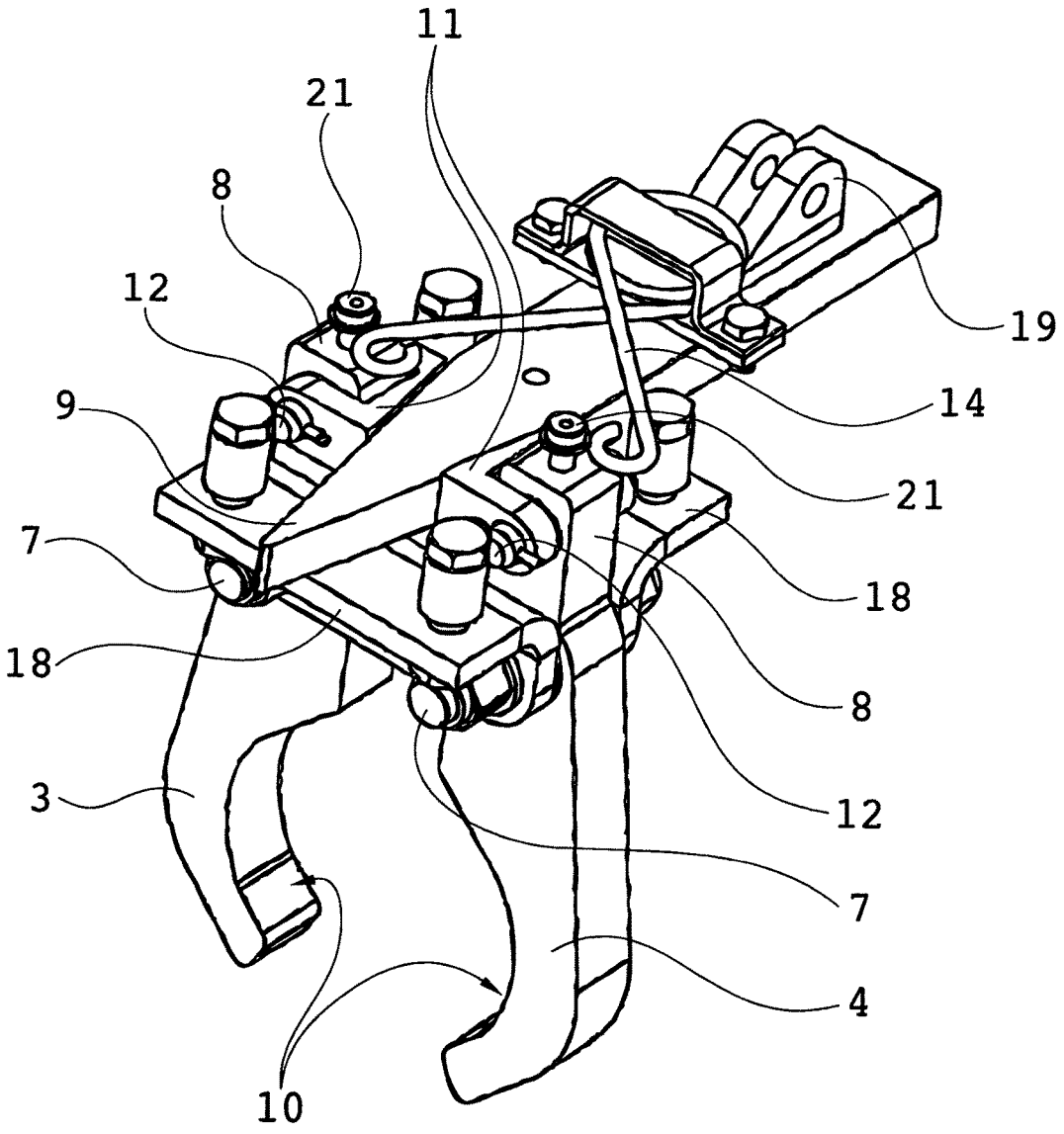
FIGS. 4*a* and 4*b* show a detail of the gripping device of FIG. 2 in different views.
Figure 4B:
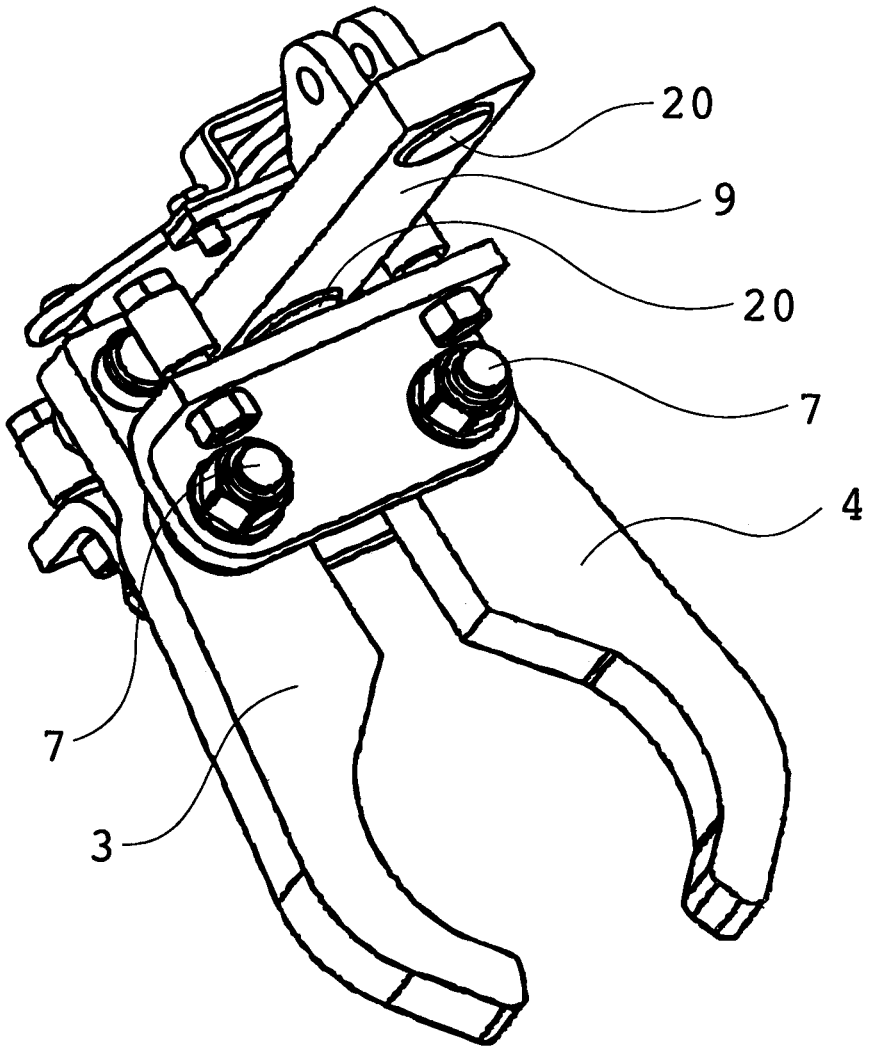

FIGS. 4*a* and 4*b* show a grip jaw pair according to FIG. 3 made free from the body 5 and other components for the sake of increased clarity. As a supplement to the above description of FIG. 3, which is also fully readable on FIGS. 4*a* and 4*b*, these Figures more clearly show fastening profiles 18 for the pivot joints 7 being comprised of a respective pivot pin. 19 indicates a fastener on the wedge device 9 for a piston rod belonging to the hydraulic cylinder 15. 20 indicates slide pads that are attached to an underside of the wedge device 9 for facilitating sliding on a glide path in the body. 21 indicates screws for co-operating with bent free ends of the spring 14 for opening actuation of the grip jaws 3 and 4.

Figure 5:
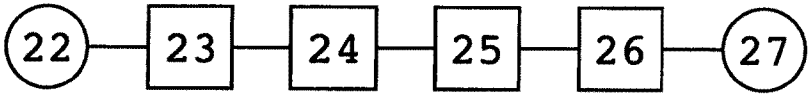
FIG. 5 illustrates diagrammatically a method sequence according to the invention.

The block diagram in FIG. 5 illustrates diagrammatically a method sequence according to the invention, wherein:

Position 22 indicates start of the sequence.

Position 23 indicates positioning the gripping device with open grip jaws before gripping a drill string component.

Position 24 indicates that at least one pivotally movable grip jaw in each grip jaw pair is pivoted around a pivot joint from the open position to a closed position controlled by a respective wedge device for gripping the drill string component.

Position 25 indicates positioning the drill string component for adding it to a drill string in rock drilling machine.

Position 26 indicates that said movable grip jaw is actuated in the direction of the open position by a spring device in the body in connection with retracting the respective wedge device.

Position 27 indicates reverting to an initial position and the end of the sequence.

The invention can be modified within the scope of the claims. Each grip jaw pair can thus include a movable and a fixed grip jaw, wherein in that case a one-sided wedge device will be required. The movable grip jaw then normally has to be subjected to a relatively important swing movement in this instant in order to allow suitable opening of the grip jaw pair which results in that a longer wedge movement can be required in this variant. It is also possible to provide one single wedge device provided with two separated wedge surfaces which thus extends over a major part of the length of the body for manoeuvring both gripping pairs, said wedge device in that case suitably being driven by one hydraulic cylinder.

The gripper elements are suitably grip jaws but can also be otherwise shaped gripper elements such as gripper elements equipped with plate-shaped abutment plates or the like. It is preferred that at least two gripper element pairs are arranged, separated from each other but it is not excluded that one single grip element pair is provided which possibly can take assistance from guiding portions that are arranged on the body and against which a drill string component is pressed by the gripper element pair in the gripping position in order to ensure stability in this gripping position. A solution with one single gripper element pair is, however, not preferred.

The term "gripper element pair" is to be interpreted as meaning one unit including a first, movable gripper element and a second, fixed or movable second grip element, which can be comprised of a similar element as the first grip element or an otherwise constructed element. An embodiment is for example possible wherein the second gripper is divided into two axial separated counter holding elements. Another embodiment is also possible wherein one or both gripper elements in a pair has longitudinal strip-shape etc.

The invention claimed is:

1. A gripping device for a drill string component handling device in a rock drill rig, the gripping device comprising:

gripper elements for engagement with a drill string component having an axial direction, wherein the gripper elements are supported by and protrude from one side of a body, wherein the gripper elements form at least one gripper element pair, wherein at least one gripper element in the at least one gripper element pair is pivotally movable around a pivot joint between a closed position, comprising a gripping position, and an open position, wherein the at least one movable gripper element is pivotal in a respective gripper plane forming a right angle to said axial direction, and wherein the at least one movable gripper element comprises an actuation portion, which co-operates with a wedge device being movable in directions parallel to said axial direction for pivoting said at least one movable gripper element.

2. The gripping device according to claim 1, wherein the at least one movable gripper element comprises the pivot joint between an engagement portion for a co-operation with a gripped drill component and the actuation portion.

3. The gripping device according to claim 1, wherein the actuation portion is pivotally joined to a contact block which lies in contact with the wedge device.

4. The gripping device according to claim 1, further comprising:

a spring device arranged in the body for actuation of said at least one movable gripper element in direction of the open position.

5. The gripping device according to claim 1, wherein at least two gripper element pairs for gripping a drill string component are arranged at a distance from each other on the body.

6. The gripping device according to claim 1, wherein said wedge device is connected to a hydraulic cylinder.

7. The gripping device according to claim 6, wherein each gripper element pair is arranged to be maneuvered by a separate wedge device, which is connected to a separate associated hydraulic cylinder.

8. The gripping device according to claim 6, wherein at least two gripper element pairs are arranged, wherein all gripper element pairs are maneuvered by a common wedge device which is coupled to an associated hydraulic cylinder.

9. The gripping device according to claim 6, wherein each hydraulic cylinder comprises a hydraulic lock, which prevents movement of the hydraulic cylinder in case of lost hydraulic pressure in associated hydraulic conduits.

10. The gripping device according to claim 1, wherein the wedge device is linear guided between fixed guiding elements being provided in the body.

11. The gripping device according to claim 1, wherein both gripper elements in each gripper element pair are pivotally movable gripper elements, and wherein the wedge device has wedge surfaces facing in different directions for co-operation with the movable gripper elements in the at least one gripper element pair.

12. The gripping device according to claim 1, wherein the the body comprises a protective cover for covering a respective actuation portion and associated movable wedge device.

13. A method for maneuvering a gripping device for a drill string component handling device in a rock drill rig, wherein the gripping device includes:

gripper elements for engagement with a drill string component having an axial direction, wherein the gripper elements are supported by and protrude from one side of a body and the gripper elements form at least one gripper element pair, wherein at least one gripper element in the at least one gripper element pair is pivotally movable around a pivot joint between a closed position, comprising a gripping position, and an open position, the method comprising:

pivoting the at least one movable gripper element in the at least one gripper element pair around a pivot joint between a closed position, comprising a gripping position, and an open position, pivoting the at least one movable gripper element in a respective gripper plane forming a right angle to said axial direction, and pivoting the at least one movable gripper element with an actuation portion being provided on the at least one movable gripper element and which co-operates with a wedge device being movable in directions parallel to said axial direction.

14. The method according to claim 13, wherein a contact block being pivotally joined to the actuation portion lies in contact with the wedge device.

15. The method according to claim 13, further comprising:

actuating said at least one movable gripper element in a direction of the open position by a spring device being arranged in the body.

16. The method according toclaim 13, further comprising driving said wedge device with a hydraulic cylinder.

17. The method according to claim 13, further comprising:

gripping the drill string component with at least two gripper element pairs being arranged at a distance from each other on the body.

18. The method according to claim 17, further comprising:

maneuvering each gripper element pair with a separate wedge device which is driven by a separate associated hydraulic cylinder.

19. The method according to claim 13, wherein both gripper elements in each gripper element pair are pivoted, and wherein the wedge device cooperates with the movable gripper elements in a gripper element pair through two wedge surfaces facing in different directions.

20. A drill string component handling device for a rock drill rig, the drill string component handling device comprising:

a gripping device for gripping drill string components, and a displacement mechanism being attachable to the rock drill rig and supporting the gripping device, the gripping device comprising gripper elements for engagement with a drill string component having an axial direction, wherein the gripper elements are supported by and protrude from one side of a body, wherein the gripper elements form at least one gripper element pair, wherein at least one gripper element in the at least one gripper element pair is pivotally movable around a pivot joint between a closed position, comprising a gripping position, and an open position, wherein the at least one movable gripper element is pivotal in a respective gripper plane forming a right angle to said axial direction, and wherein the at least one movable gripper element comprises an actuation portion, which co-operates with a wedge device being movable in directions parallel to said axial direction for pivoting said movable gripper element.

21. A rock drill rig, comprising:

a drill string component handling device comprising a gripping device for gripping drill string components, and a displacement mechanism being attachable to the rock drill rig and supporting the gripping device, the gripping device comprising gripper elements for engagement with a drill string component having an axial direction, wherein the gripper elements are supported by and protrude from one side of a body, wherein the gripper elements form at least one gripper element pair, wherein at least one gripper element in the at least one gripper element pair is pivotally movable around a pivot joint between a closed position, comprising a gripping position, and an open position, wherein the at least one movable gripper element is pivotal in a respective gripper plane forming a right angle to said axial direction, and wherein the at least one movable gripper element comprises an actuation portion, which co-operates with a wedge device being movable in directions parallel to said axial direction for pivoting said movable gripper element.

* * * * *